US009285743B2

(12) United States Patent
Aruga

(10) Patent No.: US 9,285,743 B2
(45) Date of Patent: Mar. 15, 2016

(54) IMAGE FORMING APPARATUS

(71) Applicant: CANON KABUSHIKI KAISHA, Tokyo (JP)

(72) Inventor: Daisuke Aruga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/591,648

(22) Filed: Jan. 7, 2015

(65) Prior Publication Data

US 2015/0192887 A1 Jul. 9, 2015

(30) Foreign Application Priority Data

Jan. 9, 2014 (JP) ..... 2014-002381

(51) Int. Cl.
*G03G 15/01* (2006.01)
*G03G 15/00* (2006.01)

(52) U.S. Cl.
CPC ..... *G03G 15/5058* (2013.01); *G03G 15/0178* (2013.01); *G03G 15/0189* (2013.01); *G03G 2215/0161* (2013.01)

(58) Field of Classification Search
CPC ..... G03G 15/5058; G03G 2215/0158; G03G 2215/0161
See application file for complete search history.

(56) References Cited

U.S. PATENT DOCUMENTS

2013/0322904 A1* 12/2013 Murayama ..... 399/66

FOREIGN PATENT DOCUMENTS

JP 2012-42752 A 3/2012

* cited by examiner

*Primary Examiner* — Gregory H Curran
(74) *Attorney, Agent, or Firm* — Canon USA Inc. IP Division

(57) ABSTRACT

An image forming apparatus includes an image bearing member, a first image forming unit configured to form an image in a first color on the image bearing member, a second image forming unit configured to form an image in a second color different from the first color on the image bearing member, a measurement unit configured to measure positional information of measurement images formed on the image bearing member by the first and the second image forming unit, a correction unit configured to correct a position of an image formed on the image bearing member by the first and the second image forming unit based on the positional information, a detection unit configured to detect a temperature of the image forming apparatus, and a control unit configured to control timing for causing the first and the second image forming unit to form the measurement images based on the detected temperature.

6 Claims, 10 Drawing Sheets

FIG. 9

| | ADJUSTMENT TYPE | |
|---|---|---|
| | SHORT PATTERN | LONG PATTERN |
| CORRECTION: MAIN SCANNING DIRECTION | ×(IMPOSSIBLE) | ○(POSSIBLE) |
| CORRECTION: SUB-SCANNING DIRECTION | ○(POSSIBLE) | ○(POSSIBLE) |
| NUMBER OF PATTERN SETS: MAIN SCANNING DIRECTION | 0 | 2 |
| NUMBER OF PATTERN SETS: SUB-SCANNING DIRECTION | 3 | 6 |
| ADJUSTMENT TIME [S] | 5 | 8 |

IMAGE FORMING APPARATUS

BACKGROUND OF THE INVENTION

1. Field of the Invention

The present disclosure generally relates to image forming and, more particularly, to an image forming apparatus having a function for correcting relative positions of a plurality of images in different colors (i.e., image registration correction control function).

2. Description of the Related Art

An electro-photographic type image forming apparatus forms a latent image on a photosensitive drum by exposing the photosensitive drum to light beams emitted from an optical scanning unit, and visualizes that latent image as a toner image by developing the latent image with toner. The toner image formed on the photosensitive drum is transferred onto a recording sheet or an intermediate transfer belt, fixed to the recording sheet by heat or pressure from a fixing unit, so as to be output as an output document.

Generally, the optical scanning unit includes a light source, a rotational polygon mirror rotationally driven to deflect light beams emitted from the light source, and a lens and a mirror for guiding each of the light beams deflected by the rotational polygon mirror to a photosensitive drum. These components are contained and held within an optical box.

In recent years, a configuration including a single optical scanning unit for exposing photosensitive drums of a plurality of colors has been becoming a major configuration of a color copying machine rather than a configuration including a plurality of optical scanning units corresponding to respective colors. In the above-described configuration, in particular, the optical box of the optical scanning unit is thermally expanded when an interior temperature of the image forming apparatus is changed. In addition, due to the influence of thermal distribution generated within the optical box, complex thermal expansion and deformation is caused within the optical box because of the anisotropic characteristics of glass fillers included in the materials of the optical box, so that the positions of the lens and the mirrors are changed. Therefore, a position of the light beam guided to the photosensitive drum is changed, so that an image cannot be formed on a target position if image forming processing is executed in such a condition. For example, in the image forming apparatus for forming a full-color image by superimposing images in respective color components of yellow, cyan, magenta, and black on a recording material, tint of the full-color image is changed because relative positions of the images in respective color components are misregistrated.

In order to solve the above problem, image registration correction control (color misregistration correction) has been known. For example, relative positions of measurement pattern images in respective color components are calculated by forming the measurement pattern images on the intermediate transfer belt at a predetermined timing and reading the measurement pattern images by a sensor, and writing timing of the light beams for forming images in respective color components is corrected. Through this processing, the images in respective color components are formed on desired positions, and thus the color of the full-color image can be controlled to have a desired color. However, in the color misregistration correction, because a correction pattern has to be formed at an appropriate time interval, number of printing sheets, and a temperature change amount, downtime is caused in the image forming apparatus, so that the productivity is lowered.

Japanese Patent Application Laid-Open No. 2012-42752 discusses an image forming apparatus which executes a first image registration correction control for actually measuring positions of measurement pattern images of all color components and a second image registration correction control for estimating positions of the measurement pattern images of the color components other than two color components based on a measurement result of the positions of the measurement pattern images of the two color components. The image forming apparatus discussed in Japanese Patent Application Laid-Open No. 2012-42752 executes the first image registration correction control before starting image formation in a case where a print job is input thereto after more than two hours has passed from the end of the previous printing operation while a difference between the temperature of the fixing unit and the ambient temperature is greater than 5° C., while executing the second image registration correction control in other cases.

Because the second image registration correction control is executed based on a predetermined condition, the image forming apparatus discussed in Japanese Patent Application Laid-Open No. 2012-42752 can reduce the downtime compared with the case where the first image registration correction control is executed consistently.

In the image forming apparatus discussed in Japanese Patent Application Laid-Open No. 2012-42752, the downtime is caused in a period before resuming the printing operation because both the first image registration correction control and the second image registration correction control are executed before starting the image forming processing (printing operation). Therefore, productivity of the image forming apparatus is lowered.

In the second image registration correction control, relative positions of the images in all of the color components cannot be corrected with high accuracy because positions of the images in color components other than a reference color and a target color are estimated.

SUMMARY OF THE INVENTION

The present disclosure is directed to an image forming apparatus capable of correcting misregistration of relative positions of images in respective color components with high accuracy while suppressing the downtime caused by correction processing.

According to an aspect of the present disclosure, an image forming apparatus includes an image bearing member configured to carry and convey an image, a first image forming unit configured to form an image in a first color on the image bearing member, a second image forming unit configured to form an image in a second color different from the first color on the image bearing member, a measurement unit configured to measure positional information of measurement images formed on the image bearing member by the first image forming unit and the second image forming unit, a correction unit configured to correct a position of an image formed on the image bearing member by the first image forming unit and the second image forming unit based on the positional information measured by the measurement unit, a detection unit configured to detect a temperature of the image forming apparatus, and a control unit configured to control timing for causing the first image forming unit and the second image forming unit to form the measurement images based on the temperature detected by the detection unit.

Further features of the present disclosure will become apparent from the following description of exemplary embodiments with reference to the attached drawings.

BRIEF DESCRIPTION OF THE DRAWINGS

FIG. 9 is a table illustrating various elements of the color misregistration adjustment according to an adjustment type.

DESCRIPTION OF THE EMBODIMENTS

Hereinafter, an exemplary embodiment of the present disclosure will be described with reference to the drawings.

Figure 1:
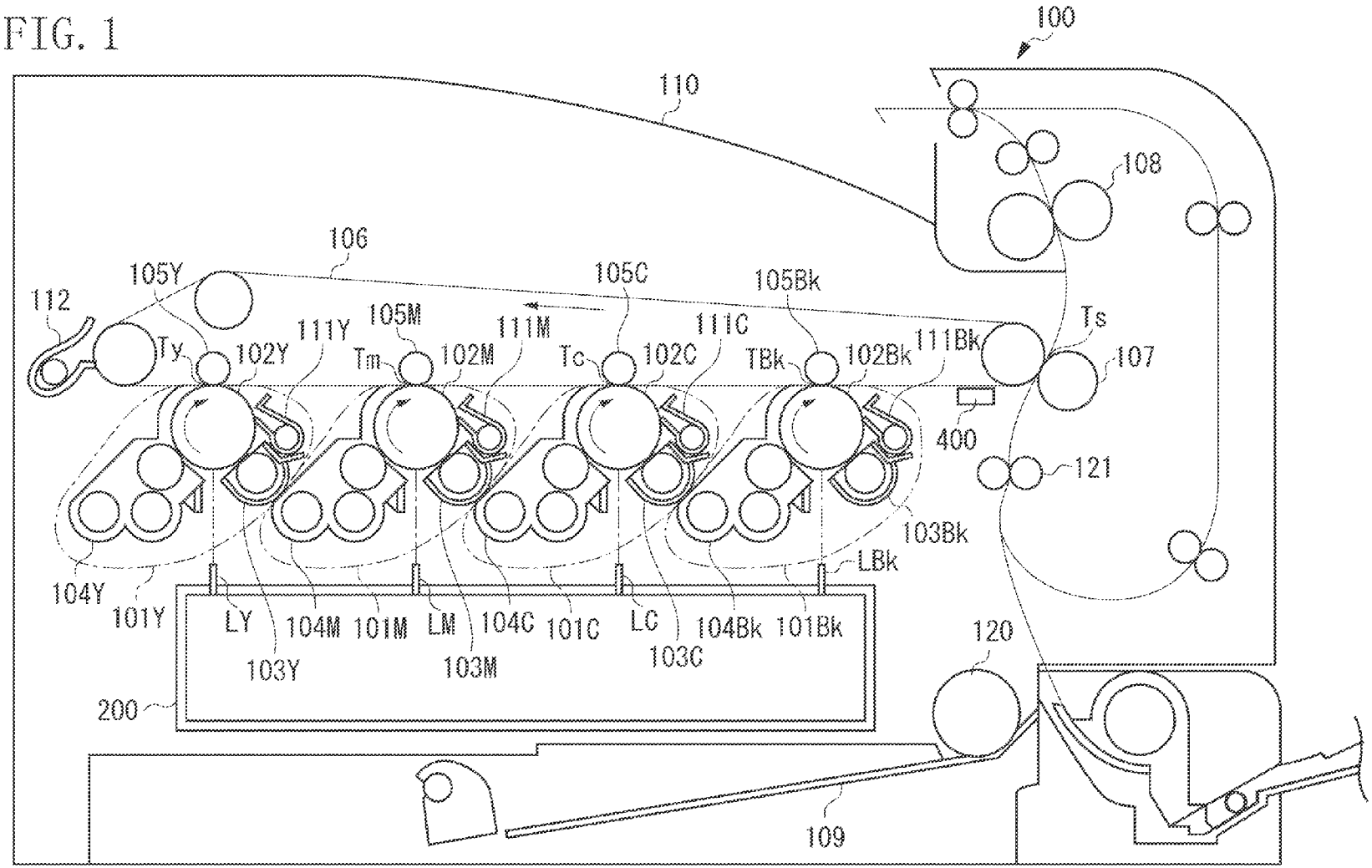
FIG. 1 is a schematic cross-sectional diagram of an image forming apparatus.

FIG. 1 is a schematic cross-sectional diagram of an image forming apparatus according to a first exemplary embodiment of the present disclosure.

An image forming apparatus 100 is an electro-photographic type image forming apparatus including four image forming units 101 (101Y, 101M, 101C, and 101Bk) for forming toner images of yellow, magenta, cyan, and black. Hereinafter, because constituent elements of the image forming units 101 are common to each other, the same reference numerals are applied thereto when the constituent elements are not distinguished from each other while "Y", "M", "C", and "Bk" are added after the reference numerals when the constituent elements are distinguished from each other at each of the image forming units 101. As used herein, the term "unit" generally refers to any combination of software, firmware, hardware or other component, such as circuitry, that is used to effectuate a purpose.

The image forming units 101 (Y, M, C, and Bk) respectively include photosensitive drums 102 (102Y, 102M, 102C, and 102Bk). These photosensitive drums 102 (Y, M, C, and Bk) are arranged at different positions in a horizontal direction. Further, the image forming units 101 respectively include charging units 103 (103Y, 103M, 103C, and 103Bk) for charging the photosensitive drums 102, and development units 104 (104Y, 104M, 104C, and 104Bk) for developing electrostatic latent images on the photosensitive drums 102. Further, the image forming units 101 respectively include cleaning units 111 (111Y, 111M, 111C, and 111Bk) for removing toner left on the photosensitive drums 102 from the photosensitive drums 102.

The image forming apparatus 100 includes transfer rollers 105 (105Y, 105M, 105C, and 105Bk), an intermediate transfer belt (intermediate transfer member) 106, a cleaning unit 112, a sheet discharge portion 110, a transfer roller 107, and a fixing unit 108. The image forming apparatus 100 further includes a container unit 109 for containing recording sheets and an optical scanning unit 200. The optical scanning unit 200 is disposed in a space between the image forming units 101 and the container unit 109 in a vertical direction.

Subsequently, an image forming process will be described. The optical scanning unit 200 emits light beams (laser light) L (LY, LM, LC, and LBk) to exposes the respective photosensitive drums 102 (Y, M, C, and Bk) charged by the charging units 103 (Y, M, C, and Bk) thereto. The photosensitive drums 102 are exposed respectively to the light beams L, so that electrostatic latent images are formed on the corresponding photosensitive drums 102.

The development units 104 (Y, M, C, and Bk) develop the electrostatic latent images formed on the photosensitive drums 102 (Y, M, C, and Bk) with toner of respective colors of yellow, magenta, cyan, and black.

The toner images formed on the photosensitive drums 102 (Y, M, C, and Bk) are transferred onto the intermediate transfer belt 106 by the transfer rollers 105 at transfer portions Ty, Tm, Tc, and TBk. At respective positions between the transfer portions Ty, Tm, Tc, and TBk in a rotational direction of the photosensitive drums 102 and charging portions of the charging units 103, the cleaning units 111 collect the toner that is left on the photosensitive drums 102 without being transferred onto the intermediate transfer belt 106.

The image forming units 101 sequentially superimpose and transfer the toner images corresponding to respective color components onto the intermediate transfer belt 106, so that a full-color toner image is formed on the intermediate transfer belt 106.

The toner image transferred onto the intermediate transfer belt 106 is conveyed to a secondary transfer portion Ts positioned between the intermediate transfer belt 106 and the transfer roller 107 according to the rotation of the intermediate transfer belt 106 in a direction indicated by an arrow (i.e., rotation in a counterclockwise direction in FIG. 1). At this time, recording sheets contained in the container unit 109 are fed by a sheet feeding roller 120 one-by-one, so as to be conveyed to the secondary transfer portion Is by a conveyance roller 121. A sheet position and sheet feeding timing of the recording sheet conveyed by the sheet feeding roller 120 is adjusted by the conveyance roller 121, so that the recording sheet is supplied to the secondary transfer portion Is to contact the toner image on the intermediate transfer belt 106. Thus, the sheet feeding roller 120 and the conveyance roller 121 function to convey the recording sheet from the container unit 109 to the sheet discharge portion 110. A path through which the recording sheet is conveyed to the sheet discharge portion 110 from the container unit 109 serves as a conveyance path.

When the toner image transferred onto the intermediate transfer belt 106 and the recording sheet fed through the conveyance roller 121 enter the secondary transfer portion Ts, transfer voltage is applied to the transfer roller 107, so that the toner image on the intermediate transfer belt 106 is transferred onto the recording sheet. The recording sheet on which the toner image has been transferred at the secondary transfer portion Ts is conveyed to the fixing unit 108. The fixing unit 108 fixes the toner image on the recording sheet by applying heat while conveying the recording sheet. Thereafter, the recording sheet on which the toner image is fixed is discharged to the sheet discharge portion 110. The optical scanning unit 200, the image forming units 101, the intermediate transfer belt 106, the transfer roller 107, and the fixing unit 108 function to cooperatively perform image forming.

The image forming apparatus 100 includes the cleaning unit 112 disposed at a position between the secondary transfer portion Ts and the transfer portion Ty in the rotational direction of the intermediate transfer belt 106. The cleaning unit 112 includes a blade which makes contact with the intermediate transfer belt 106 in order to scrape and remove the toner that is left on the intermediate transfer belt 106 without being transferred to the recording sheet by the blade.

The image forming apparatus 100 includes an image registration correction control function for correcting the color misregistration of a plurality of images in different colors, which is also referred to as "color misregistration correction" or "color misregistration adjustment". Therefore, the image forming apparatus 100 includes a color misregistration detection sensor 400 in the vicinity of the intermediate transfer belt 106. Although description thereof will be given below in detail, the color misregistration correction patterns (hereinafter, also simply referred to as "correction patterns") for respective colors of yellow, magenta, cyan, and black for correcting the color misregistration are formed on the intermediate transfer belt 106. The color misregistration detection sensor 400 detects the correction patterns of respective colors. The correction patterns are measurement images configured of toner images in respective colors.

The color misregistration detection sensor 400 is arranged at a position where all the correction patterns in four colors can be detected thereby while the pattern shapes are not deformed by the pressure from the transfer roller 107 at the secondary transfer portion Ts. The color misregistration detection sensor 400 is arranged at a position between the transfer portion TBk and the secondary transfer portion Ts in a moving direction of the intermediate transfer belt 106 (i.e., conveyance direction of the toner image).

Figure 2B:
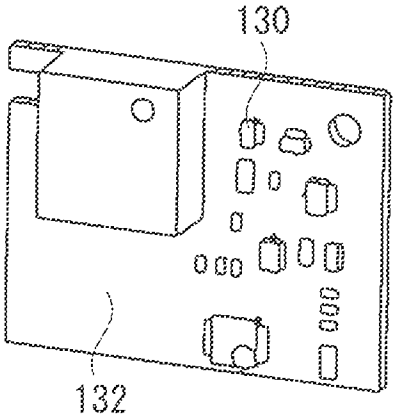
FIG. 2B is a perspective view of a substrate having an electric contact included in the image forming unit.
Figure 2A:
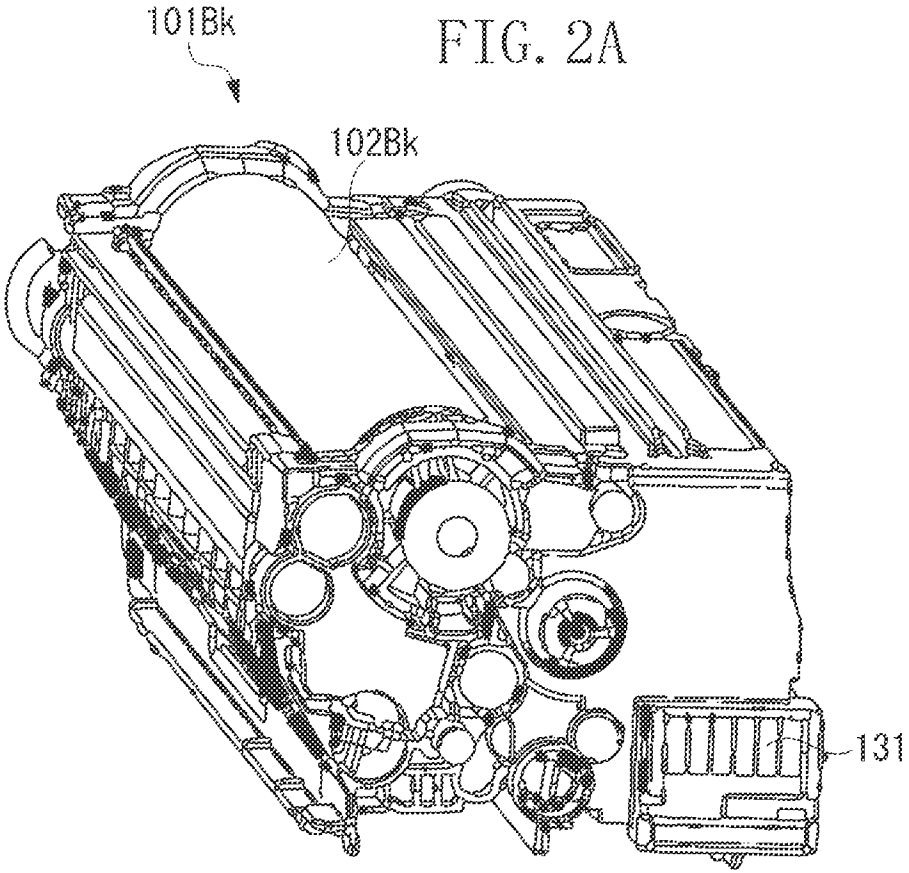
FIG. 2A is a perspective view of an image forming unit.

FIG. 2A is a perspective view of the image forming unit 101Bk, and FIG. 2B is a perspective view of a substrate 132 included in the image forming unit 101Bk.

A temperature sensor 130 is disposed on the substrate 132 of the image forming unit 101Bk. In order to apply voltage to the above-described charging unit 103, the image forming unit 101Bk includes an electric contact 131 for distributing the power. FIG. 2B is a diagram illustrating a back side of the substrate 132 having the electric contact 131. The temperature sensor 130 is disposed at a portion of the substrate 132. The temperature sensor 130 serves as a measurement unit for measuring an interior temperature of the image forming apparatus 100, and any configuration may be employed as long as the temperature sensor can measure and detect the interior temperature. The temperature sensor 130 may be disposed at any image forming unit 101 other than the image forming unit 101Bk. The temperature sensor 130 may be disposed in the vicinity of the photosensitive drum 102. Alternatively, the temperature sensor 130 may be disposed at the optical scanning unit 200, a fixing unit 108, or in any of the vicinities thereof. Furthermore, the temperature sensor 130 may be disposed within the optical scanning unit 200.

Figure 3:
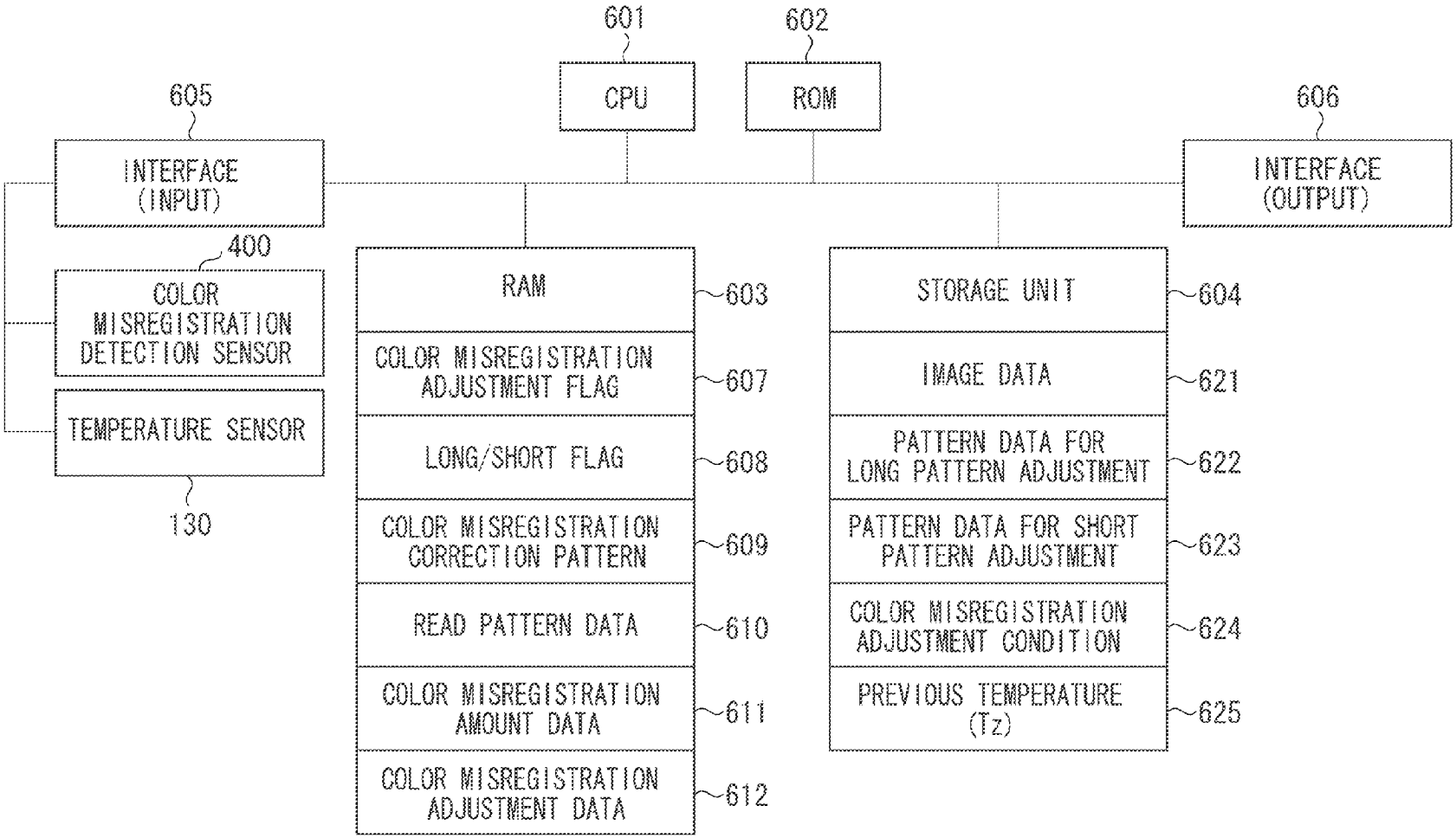
FIG. 3 is a block diagram illustrating a system configuration of the image forming apparatus.

FIG. 3 is a block diagram illustrating a system configuration of the image forming apparatus 100. A read only memory (ROM) 602, a random access memory (RAM) 603, a storage unit 604, and interfaces 605 and 606 are connected to a central processing unit (CPU) 601 for executing arithmetic processing.

The interface 605 transmits a signal received from the color misregistration detection sensor 400 and the temperature sensor 130 to the CPU 601. The interface 606 transfers a control signal from the CPU 601 to respective units. The ROM 602 stores a fixed parameter used by the CPU 601. The RAM 603 is used as a system work memory. The storage unit 604 is configured of a non-volatile memory or a disk, and stores a program executed by the CPU 601 and parameters.

Figure 7:
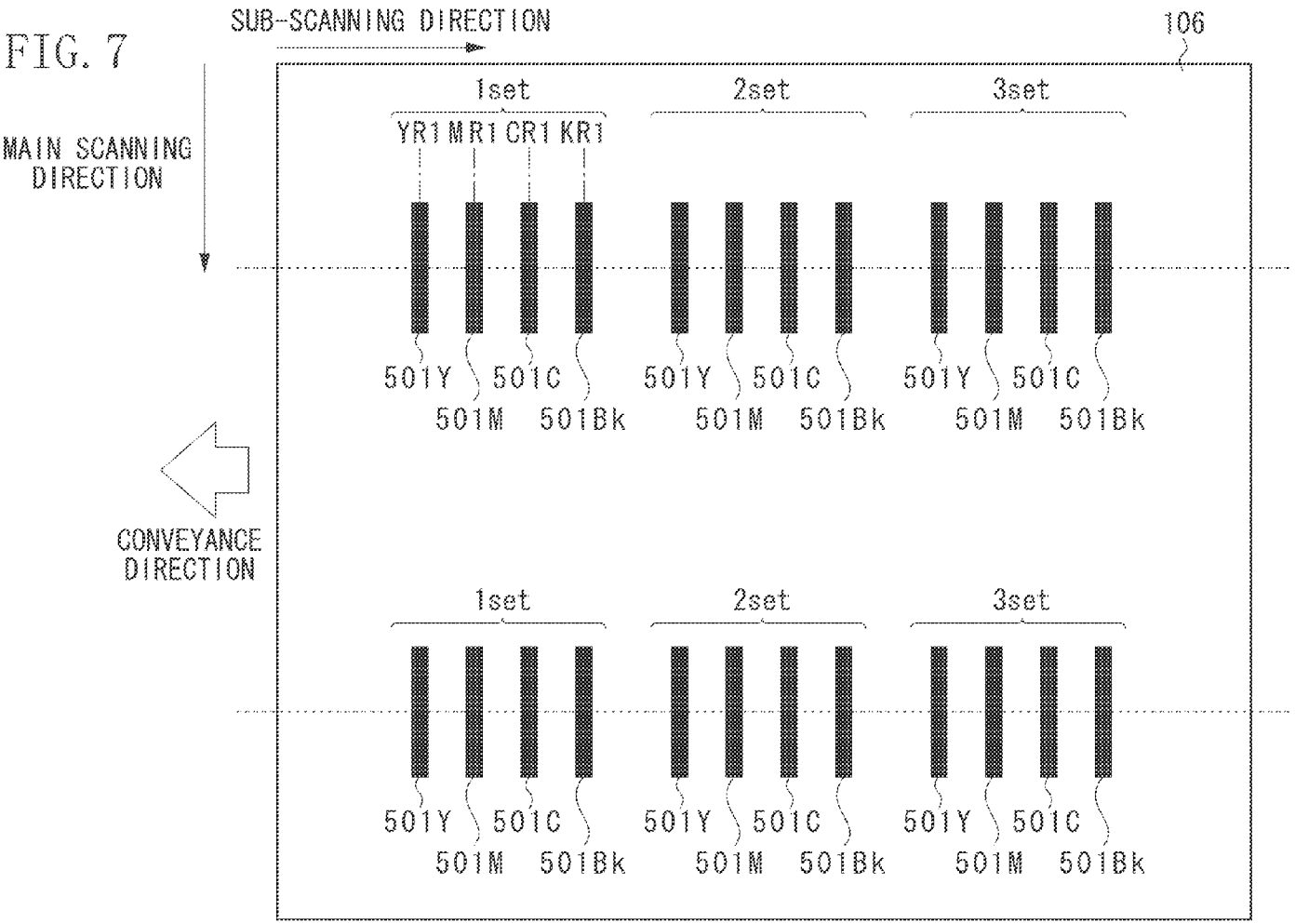
FIG. 7 is a diagram illustrating a short pattern arrangement employed for a first color misregistration adjustment.
Figure 8:
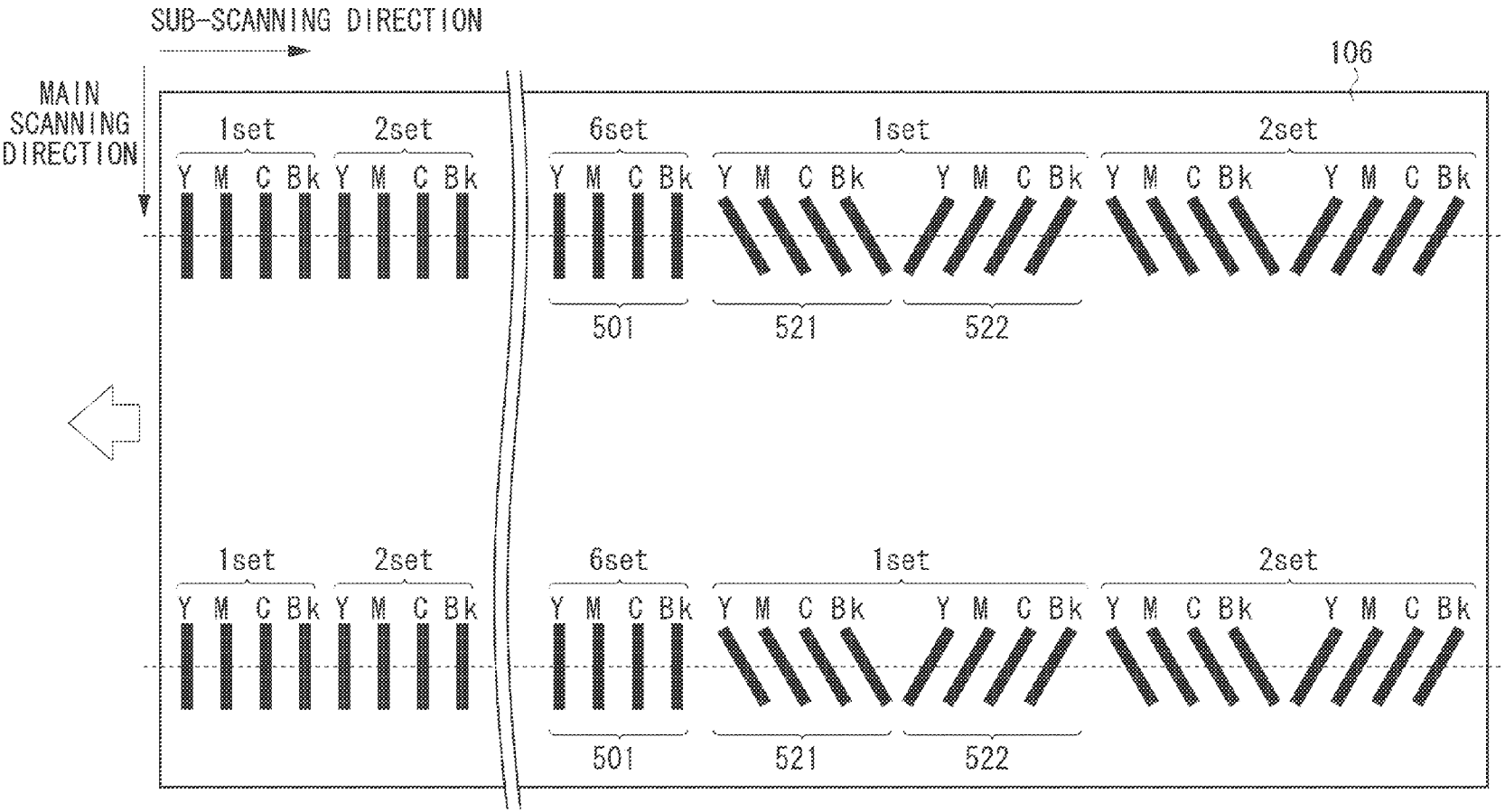
FIG. 8 is a diagram illustrating a long pattern arrangement employed for a second color misregistration adjustment.

At least two types of color misregistration adjustments, a first color misregistration adjustment and a second color misregistration adjustment, are provided as the color misregistration adjustment. Any one of the two types of color misregistration adjustments is selected and executed selectively according to the control of the CPU 601. In the first color misregistration adjustment, a short pattern (first measurement image) described below with reference to FIG. 7 is used as the correction pattern. In the second color misregistration adjustment, both the short pattern and a long pattern (second measurement image) described below with reference to FIG. 8 are used as the correction pattern.

Regions 607 to 612 for storing the following data are secured in the RAM 603. A color misregistration adjustment flag for indicating a determination result of the execution timing of the color misregistration adjustment is stored in the region 607. The color misregistration adjustment flag is set according to a comparison result of a difference (change amount) between an interior temperature Tz at the previous color misregistration adjustment and a current interior temperature, with a threshold value. A result of determination on whether to execute the first color misregistration adjustment or the second color misregistration adjustment is stored in the region 608. A type of color misregistration correction pattern used for the color misregistration adjustment is stored in the region 609. The short pattern is set when the first color misregistration adjustment is executed whereas the long pattern is set when the second color misregistration adjustment is executed.

Read data indicating a result of reading the formed correction pattern by the color misregistration detection sensor 400 is stored in the region 610. Data relating to a misregistration amount (color misregistration amount) of relative positions of magenta, cyan, and black with reference to yellow, which is calculated based on the read data, is stored in the region 611. Color misregistration adjustment data in a main scanning direction and a sub-scanning direction (i.e., data indicating reading timing), which is calculated from the data relating to the misregistration amount of the detected relative positions, is stored in the region 612.

Herein, the "main scanning direction" and the "sub-scanning direction" are defined as follows. With respect to the surface of the photosensitive drum 102, a direction parallel to an axis line of a rotational axis is referred to as the main scanning direction whereas a circumferential direction thereof is referred to as the sub-scanning direction. With respect to the intermediate transfer belt 106, for the sake of simplicity, a belt width direction parallel to the axis line of the photosensitive drum 102 is referred to as the main scanning direction whereas a moving direction of the intermediate transfer belt 106 orthogonal to the main scanning direction is referred to as the sub-scanning direction.

Regions 621 to 625 for storing the following data are secured in the storage unit 604. Image data on which the image forming apparatus 100 executes image forming processing is stored in the region 621. Pattern data for the long pattern used in the second color misregistration adjustment is stored in the region 622. Pattern data for the short pattern used in the first color misregistration adjustment is stored in the region 623.

Color misregistration adjustment conditions such as temperature differences T0, T1, and T2 are stored in the region 624 as threshold values serving as determination references relating to the color misregistration adjustment flag (in region 607) and the long/short flag (in region 608). The interior temperature measured by the temperature sensor 130 at the time of executing the latest color misregistration correction is stored in the region 625 as a previous temperature Tz.

Basically, the color misregistration adjustment is executed in a same manner as in a conventional color misregistration correction control. More specifically, color misregistration correction patterns in respective colors are formed on the intermediate transfer belt 106, so that these color misregistration correction patterns in respective colors are read by the color misregistration detection sensor 400. Then, by using the color misregistration amount calculated from the reading result as a correction value, writing timing of the light beams is corrected in the subsequent image forming processing. However, different from the conventional technique, in the present exemplary embodiment, necessity of the color misregistration adjustment, type of the color misregistration adjustment, and execution timing of the color misregistration adjustment are determined according to the current interior temperature.

Figure 4A:
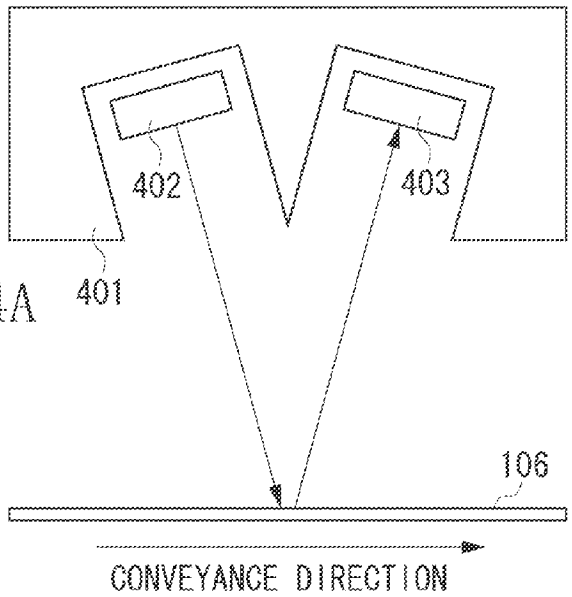
FIGS. 4A and 4C are schematic diagrams each illustrating a configuration of a color misregistration detection sensor.
Figure 4B:
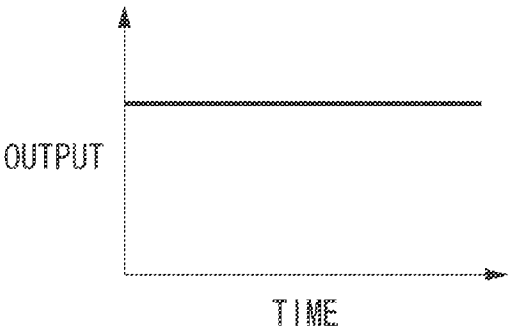
FIGS. 4B and 4D are graphs each illustrating an output waveform of the color misregistration detection sensor.
Figure 4C:
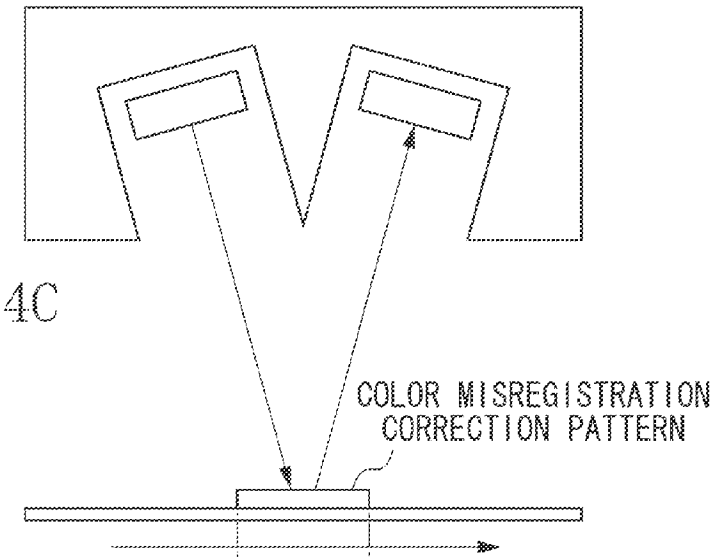

Next, a configuration of the color misregistration detection sensor 400 will be described with reference to FIGS. 4A, 4B, 4C, and 4D. FIGS. 4A and 4C are schematic diagrams illustrating a configuration of the color misregistration detection sensor 400. FIG. 4B is a graph illustrating an output waveform of the color misregistration detection sensor 400 when the color misregistration correction pattern is not present on the intermediate transfer belt 106, and FIG. 4D is a graph illustrating an output waveform of the color misregistration detection sensor 400 when the color misregistration correction pattern is present on the intermediate transfer belt 106.

As illustrated in FIG. 4A, the color misregistration detection sensor 400 includes a light emitting device 402 and a light receiving device 403 disposed on a sensor housing 401. For example, a light-emitting diode (LED) may be employed for the light emitting device 402, and a phototransistor may be employed for the light receiving device 403. In order to project light onto a surface of the intermediate transfer belt 106, the sensor housing 401 is provided with an optical path. The light receiving device 403 is disposed at a position where the light emitted from the light emitting device 402 and reflected on the intermediate transfer belt 106 can be received thereby, so as to convert intensity of the received light into an electric signal. The light receiving device 403 is disposed at a position where the light emitted from the light emitting device 402 can enter the light receiving device 403 by specular reflection. Therefore, the amount of normal reflection light received by the light receiving device 403 is greater than the amount of diffused light received thereby.

Figure 4D:
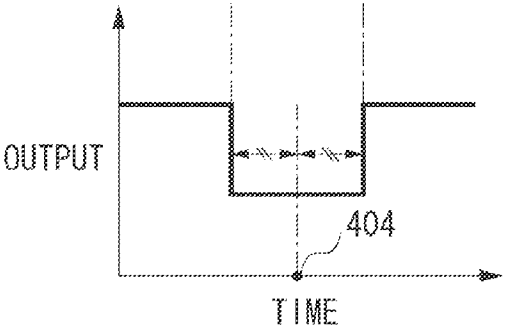

In each of the output waveforms of the color misregistration detection sensor 400 illustrated in FIGS. 4B and 4D, a horizontal axis represents time whereas a vertical axis represents an output indicating the intensity of detected light converted into the electric signal by the light receiving device 403. FIG. 4B is a graph illustrating an output waveform of the color misregistration detection sensor 400 when the color misregistration detection sensor 400 detects the light reflected from the intermediate transfer belt 106 as illustrated in FIG. 4A. FIG. 4D is a graph illustrating an output waveform of the color misregistration detection sensor 400 when the color misregistration sensor 400 detects the light reflected from the correction pattern formed on the intermediate transfer belt 106 as illustrated in FIG. 4C.

In a case where the color misregistration correction pattern is not present on the intermediate transfer belt 106, the color misregistration detection sensor 400 detects the light reflected from the intermediate transfer belt 106, and thus the output value indicates a constant value as illustrated in FIG. 4B. On the other hand, in a case where the color misregistration correction pattern is present on the intermediate transfer belt 106, the output waveform is changed when the correction pattern passes through a light irradiation position (see FIG. 4D).

When the correction pattern passes through the light irradiation position (i.e., detection region), the output value is lowered because reflectance of the intermediate transfer belt 106 is lowered. Time during which the output value is lowered corresponds to a passing time of the correction pattern. Accordingly, a centroid position 404 serving as a center of the correction pattern in the conveyance direction can be detected from the passing time and a driving speed of the intermediate transfer belt 106.

Figure 5:
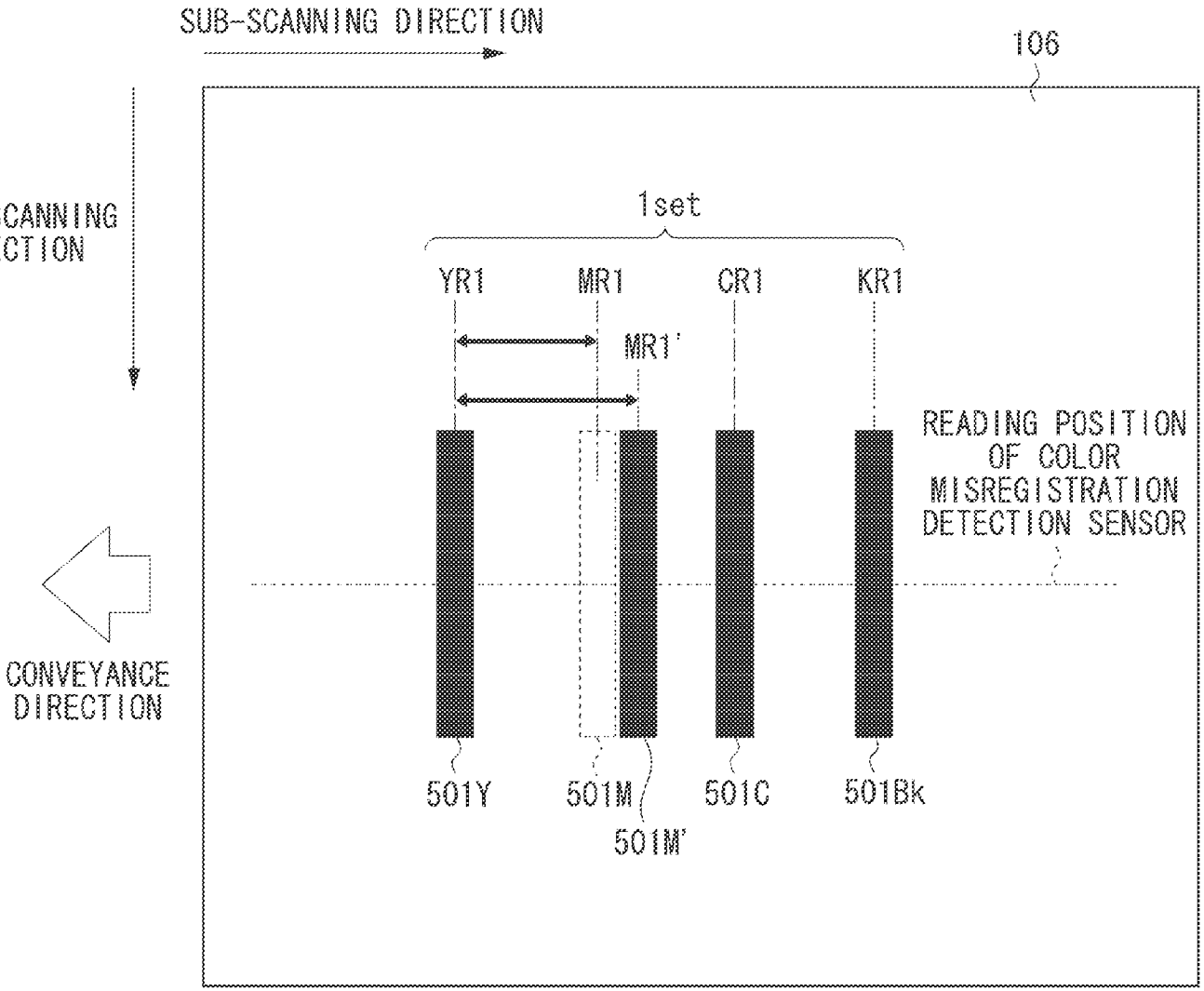
FIG. 5 is a diagram illustrating an example of a color misregistration correction pattern for a sub-scanning direction.
Figure 6:
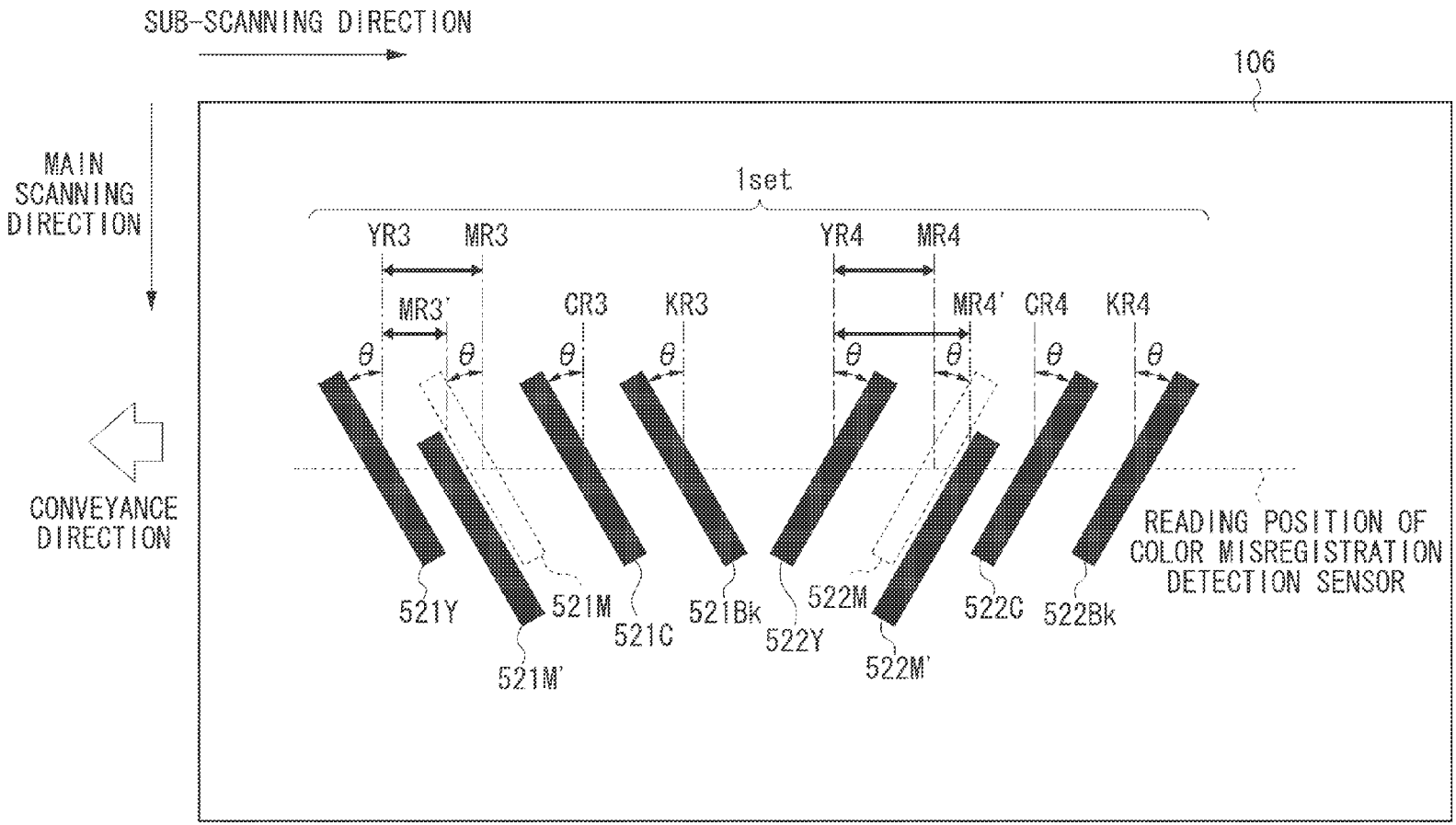
FIG. 6 is a diagram illustrating an example of a color misregistration correction pattern for a main scanning direction.

Subsequently, the color misregistration correction pattern will be described with reference to FIGS. 5 and 6. Because the color misregistration may occur in both the main scanning direction and the sub-scanning direction, the color misregistration correction patterns for correcting the misregistration in both directions are necessary. A color misregistration correction pattern 501 illustrated in FIG. 5 is used for correcting the color misregistration in the sub-scanning direction. Color misregistration correction patterns 521 and 522 illustrated in FIG. 6 are used for correcting the color misregistration in the main scanning direction. In the present exemplary embodiment, yellow that is positioned on the most upstream side is used as a reference color, and data (color misregistration amount) relating to relative positions of magenta, cyan, and black with respect to yellow is calculated individually. However, the reference color is not limited to yellow.

FIG. 5 is a diagram illustrating an example of the color misregistration correction pattern 501 for the sub-scanning direction. Correction patterns 501Y, 501M, 501C, and 501Bk corresponding to yellow, magenta, cyan, and black are formed on the intermediate transfer belt 106 as the correction pattern 501 through the above-described image forming function. Each correction pattern 501 is a line-shaped pattern parallel to the main scanning direction, and the correction patterns 501M, 501C, and 501Bk are formed on the intermediate transfer belt 106 at intervals in the sub-scanning direction from the correction pattern 501Y serving as a reference color. A set of the correction patterns 501 in respective colors (4 lines in total) is taken as one set of color misregistration correction patterns for the sub-scanning direction.

Centroid positions of the correction patterns 501 in respective colors in the sub-scanning direction read by the color misregistration detection sensor 400 are expressed as centroid positions YR1, MR1, CR1, and KR1, respectively. A reading position of the color misregistration detection sensor 400 in the main scanning direction is indicated by a dotted line in FIG. 5.

Calculation of the color misregistration amount will be described by taking the magenta correction pattern 501M as an example. When the exposure position of the photosensitive drum 102 in the sub-scanning direction is changed due to thermal expansion of the optical scanning unit 200, the correction pattern 501M is formed on a centroid position MR1' shifted from the target centroid position MR1 in the sub-scanning direction instead of being formed on the target centroid position MR1. A color misregistration amount Za of the magenta correction pattern 501M with respect to the yellow correction pattern 501Y in the sub-scanning direction can be acquired by the following formula 1.

$$Za=(MR1'-YR1)-(MR1-YR1)=MR1'-MR1 \quad \text{Formula 1}$$

The color misregistration amount Za is stored in the region 611 of the RAM 603 illustrated in FIG. 3. Color misregistration adjustment data is calculated from the color misregistration amount Za by the CPU 601, so as to be stored in the region 612 as a correction value. The CPU 601 feeds back the color misregistration adjustment data to the image forming data to correct the writing timing of the magenta image of the optical scanning unit 200, so as to correct the color misregistration in the sub-scanning direction.

Similarly, the color misregistration correction of the other colors in the sub-scanning direction can be executed through the calculation of the color misregistration amount and the color misregistration adjustment data by detecting the centroid positions of the cyan and black correction patterns 501C and 501Bk with respect to the yellow correction pattern 501Y.

FIG. 6 is a diagram illustrating an example of the color misregistration correction patterns 521 and 522 for the main scanning direction. Correction patterns 521Y, 521M, 521C, and 521Bk in respective colors of yellow, magenta, cyan, and black are formed on the intermediate transfer belt 106 as the correction pattern 521 through the above-described image forming function. Further, correction patterns 522Y, 522M, 522C, and 522Bk in respective colors of yellow, magenta, cyan, and black are formed on the intermediate transfer belt 106 as the correction pattern 522.

The correction patterns 521 and 522 are line-shaped patterns inclined with respect to the main scanning direction although inclination directions are different from each other. The correction pattern 521 is formed to have an angle of +θ with respect to the main scanning direction. The correction pattern 522 is formed to have an angle of −θ with respect to the main scanning direction. The correction patterns 521M, 521C, and 521Bk are formed on the intermediate transfer belt 106 at intervals in the sub-scanning direction from the yellow correction pattern 521Y serving as a reference color. Further, the correction patterns 522M, 522C, and 522Bk are formed on the intermediate transfer belt 106 at intervals in the sub-scanning direction from the yellow correction pattern 522Y serving as a reference color.

The correction patterns 521 and 522 for the main scanning direction in respective colors, eight correction patterns in total, are taken as one set. Centroid positions of the correction patterns 521 and 522 in respective colors in the sub-scanning direction read by the color misregistration detection sensor 400 are expressed as centroid positions YR3, MR3, CR3, KR3, YR4, MR4, CR4, and KR4, respectively. The color misregistration in the main scanning direction is also calculated from the centroid positions in the sub-scanning direction. A reading position of the color misregistration detection sensor 400 in the main scanning direction is indicated by a dotted line in FIG. 6.

Calculation of the color misregistration amount will be described by taking the magenta correction patterns 521M and 522M as examples. When the exposure position of the photosensitive drum 102 in the main scanning direction is changed due to thermal expansion of the optical scanning unit 200, the correction patterns 521M and 522M are not formed on the target centroid positions MR3 and MR4. The correction patterns 521M' and 522M' are formed on centroid positions MR3' and MR4' shifted from the target centroid positions MR3 and MR4 in the main scanning direction.

Because the correction patterns 521M' and 522M' are transferred from the same photosensitive drum 102M, the pattern-forming positions in the main scanning direction coincide with each other. Accordingly, a color misregistration amount Za2 of the magenta correction patterns 521M' and 522M' with respect to the yellow correction patterns 521Y and 522Y in the sub-scanning direction can be acquired by the following formula 2.

$$Za2=((MR3'-YR3)-(MR4'-YR4))/2 \quad \text{Formula 2}$$

Then, by using the inclination angle θ of the correction pattern to convert the direction into the main scanning direction, a color misregistration amount Zb of the correction patterns 521M' and 522M' with respect to the correction patterns 521Y and 522Y in the main scanning direction can be acquired by the following formula 3.

$$Zb=((MR3'-YR3)-(MR4'-YR4))/2\tan\theta \quad \text{Formula 3}$$

The color misregistration amount Zb is stored in the region 611 of the RAM 603 (see FIG. 3). Color misregistration adjustment data is calculated from the color misregistration amount Zb by the CPU 601, so as to be stored in the region 612 as a correction value. The CPU 601 feeds back the color misregistration adjustment data onto the image forming data to correct the writing timing of the image of the optical scanning unit 200, so as to correct the color misregistration in the main scanning direction.

Similarly, the color misregistration correction of the other colors in the main scanning direction can be executed through the calculation of the color misregistration amount and the color misregistration adjustment data by detecting the centroid positions of the cyan and black correction patterns 521C, 521Bk, 522C, and 522Bk with respect to the yellow correction patterns 521Y and 522Y.

Subsequently, examples of the correction patterns in the color misregistration adjustment will be described with reference to FIGS. 7 and 8. FIG. 7 is a diagram illustrating a short pattern formed in the first color misregistration adjustment. In order to detect the positions in the sub-scanning direction, three sets of the correction patterns 501 in four colors are respectively formed at different positions in the main scanning direction of the intermediate transfer belt 106 as a short pattern. The first set to the third set of the correction patterns 501 are arranged in the sub-scanning direction side-by-side. The CPU 601 uses six sets of the correction patterns 501 in total, and averages the color misregistration amounts Za calculated from the respective sets.

Through the above calculation, the CPU 601 can cancel the variation in detection values (detection error) of the color misregistration detection sensor 400 and color misregistration components caused by a driving cycle of the photosensitive drum 102 or the intermediate transfer belt 106. In addition, although three sets of the correction patterns 501 are taken as the example, any number of correction patterns 501 greater than two sets may be employed. In-plane color misregistration of the image can be also corrected by arranging the correction patterns at different positions in the main scanning direction of the intermediate transfer belt 106.

FIG. 8 is a diagram illustrating a long pattern formed in the second color misregistration adjustment. At first, six sets of the correction patterns 501 for the sub-scanning direction are respectively formed at different positions in the main scanning direction of the intermediate transfer belt 106 as the long pattern. The first set to the sixth set of the correction patterns 501 are arranged in the sub-scanning direction side-by-side. In addition thereto, two sets of the color misregistration correction patterns 521 and 522 for the color misregistration correction in the main scanning direction (eight pieces in total) are respectively formed at different positions in the main scanning direction of the intermediate transfer belt 106. The first set and the second set of the correction patterns 521 and 522 are arranged in the sub-scanning direction side-by-side.

The number of correction patterns 501 is greater in the long pattern (twelve sets in total) than that in the short pattern (six sets in total). With this arrangement, accuracy of the color misregistration correction in the sub-scanning direction is improved. Further, in the second color misregistration adjustment, the CPU 601 also executes the color misregistration correction in the main scanning direction by measuring the data relating to the relative positions of respective colors included in the correction patterns 521 and 522 which are not included in the short pattern. Therefore, in the first color misregistration adjustment control, the position of the image in the sub-scanning direction is corrected whereas the position of the image in both the sub-scanning direction and the main scanning direction is corrected in the second color misregistration adjustment control.

In addition, any number of correction patterns 501 greater than the correction patterns 501 formed in the first color misregistration adjustment control may be formed in the second color misregistration adjustment control. Any number of correction patterns 521 and 522 equal to or greater than one set can be arranged as the long pattern arrangement, and thus the number of correction patterns 521 and 522 is not limited to the above.

FIG. 9 is a table collectively illustrating various elements of the color misregistration adjustment.

In the first color misregistration adjustment using the short pattern, only the color misregistration correction in the sub-scanning direction can be executed. On the other hand, in the second color misregistration adjustment using the long pattern, the color misregistration correction in both the main scanning direction and the sub-scanning direction can be executed.

In the first color misregistration adjustment using the short pattern, three sets of the correction patterns 501 are formed in the sub-scanning direction while the correction patterns 521 and 522 are not formed. According to an experiment, it takes five seconds until the color misregistration detection sensor 400 has read the correction patterns after the optical scanning unit 200 executes exposure-scanning processing on the photosensitive drum 102 to form the correction patterns on the intermediate transfer belt 106.

On the other hand, in the second color misregistration adjustment using the long pattern, six sets of the correction patterns 501 are formed in the sub-scanning direction. Additionally, two sets of the correction patterns 521 and 522 are formed in the sub-scanning direction. According to the experiment, the time taken for the second color misregistration adjustment is eight seconds, which is longer than the time taken for the first color misregistration adjustment because the number of correction patterns arranged in the sub-scanning direction is greater. In addition, the moving speed of the intermediate transfer belt 106 is the same in the first and the second color misregistration adjustment control.

As described above, the first color misregistration adjustment is suitable for suppressing the lowering of productivity because the time taken for the color misregistration correction is shorter in the first color misregistration adjustment than in the second color misregistration adjustment. On the other hand, although the second color misregistration adjustment uses longer adjustment time, the second color misregistration adjustment is suitable for preferentially increasing the correction accuracy by correcting the color misregistration in both the main scanning direction and the sub-scanning direction.

Subsequently, description will be given of the processing for determining whether to execute the color misregistration adjustment and the processing for controlling the execution timing of the color misregistration adjustment (color misregistration adjustment control), each of which is executed when the image forming processing is executed.

Figure 10:
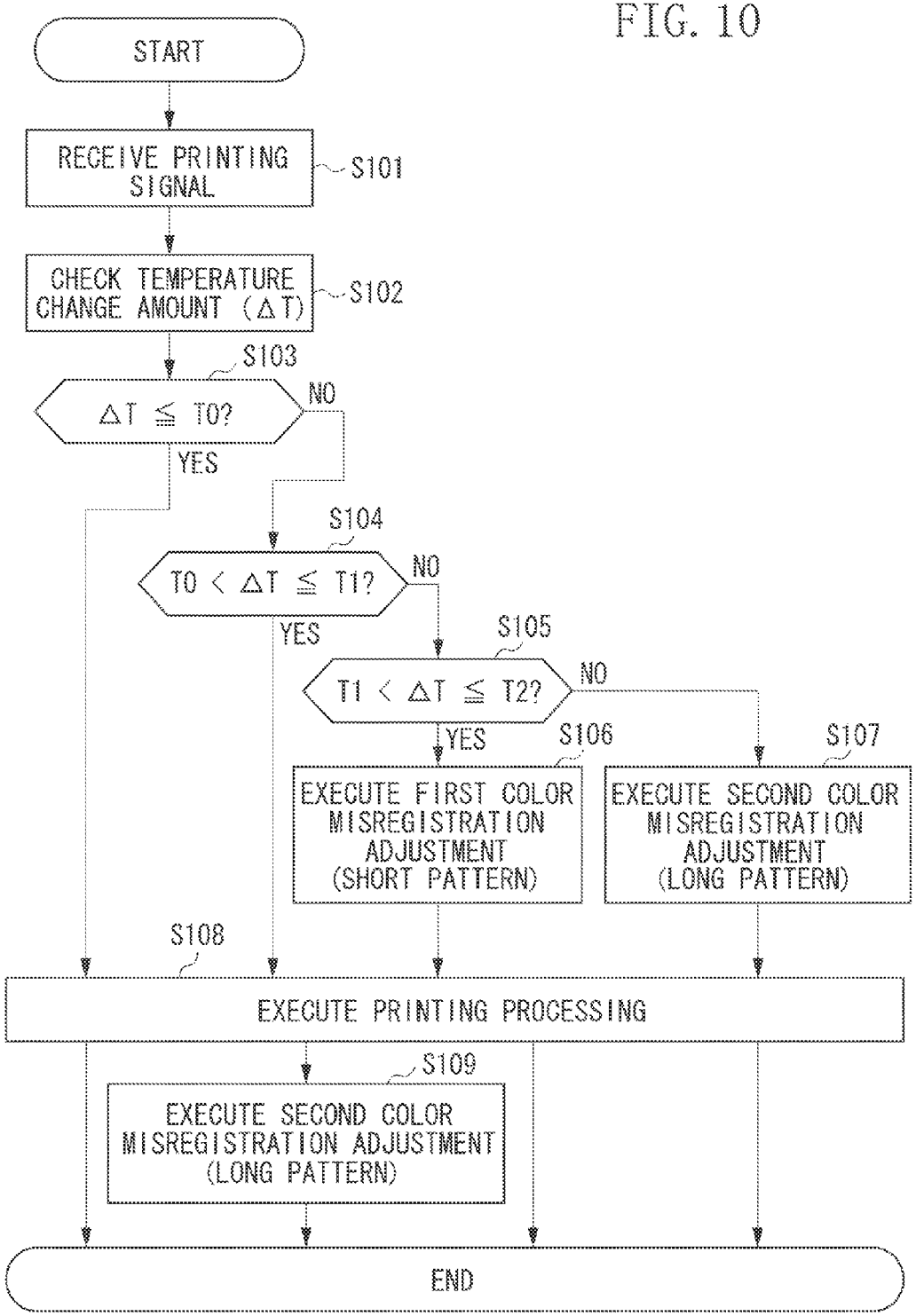
FIG. 10 is a flowchart illustrating control processing of the color misregistration adjustment.

FIG. 10 is a flowchart illustrating control processing of the color misregistration adjustment executed by the CPU 601. In the processing, the temperature differences T0, T1 (first temperature difference), and T2 (second temperature difference) are used as the threshold values. For illustrative purpose, the temperature differences T0, T1, and T2 are set, for example, as 2° C., 3° C., and 4° C., respectively. However, the threshold values may be set as appropriate as long as the magnitude relation "T0<T1<T2" is satisfied.

First, in step S101, in a case where the CPU 601 receives a printing signal while the image forming apparatus 100 is turned on, the processing proceeds to step S102. In step S102, the CPU 601 reads the previous temperature Tz stored in the region 625 as the interior temperature measured by the temperature sensor 130 at the previous color misregistration adjustment. At the same time, the CPU 601 compares the current temperature (i.e., current interior temperature) currently measured by the temperature sensor 130 and the previous temperature Tz. Herein, as to whether the previous color misregistration adjustment was the first color misregistration adjustment or the second color misregistration adjustment is not taken into consideration. Then, the CPU 601 calculates a difference between the previous temperature Tz and the current temperature as a temperature change amount ΔT.

Next, in step S103, the CPU 601 determines whether "ΔT≤T0 (2° C.)" is satisfied. In a case where "ΔT≤T0" is satisfied (YES in step S103), the processing proceeds to step S108. In step S108, the CPU 601 executes image forming processing (printing processing) according to the received printing signal because it is not necessary to execute the color misregistration adjustment. Thereafter, the CPU 601 ends the processing in FIG. 10.

On the other hand, in step S103, in a case where "ΔT≤T0" is not satisfied (NO in step S103), the processing proceeds to step S104. When the difference between the previous temperature Tz and the current temperature is greater than 2° C., the CPU 601 determines that there is a possibility that the position of the image has been changed. Therefore, if the processing proceeds to step S104, the CPU 601 (correction unit) executes the color misregistration correction (color misregistration adjustment). In step S104, the CPU 601 determines whether "T0<ΔT≤T1 (3° C.)" is satisfied. The CPU 601 sets the color misregistration adjustment flag stored in the region 607 (see FIG. 3) according to the determination result.

In a case where "T0<ΔT≤T1" is satisfied (YES in step S104), the CPU 601 determines that the color misregistration adjustment control does not have to be executed at a timing immediately before the image forming processing. Thus, the processing proceeds to step S108. In step S108, the CPU 601 executes the image forming processing, and the processing proceeds to step S109. In step S109, the CPU 601 executes the color misregistration adjustment according to the second color misregistration adjustment. In this case, the color misregistration adjustment is executed at a timing after the image forming processing has been executed so that the downtime before the image forming processing is reduced. Then, the second color misregistration adjustment using the long pattern having high correction accuracy is employed. Thereafter, the CPU 601 ends the processing in FIG. 10. In other words, priority is placed on suppression of the downtime when the color misregistration amount is small.

On the other hand, in step S104, in a case where "T0<ΔT≤T1" is not satisfied (NO in step S104), the processing proceeds to step S105. In step S105, the CPU 601 determines whether "T1<ΔT≤T2 (4° C.)" is satisfied. The CPU 601 sets the long or short flag stored in the region 608 (see FIG. 3) according to the determination result of step S105.

In a case where "T1<ΔT≤T2" is satisfied (YES in step S105), the processing proceeds to step S106. In step S106, the CPU 601 executes the color misregistration adjustment according to the first color misregistration adjustment before the image forming processing. On the other hand, in a case where "T1<ΔT≤T2" is not satisfied (i.e., ΔT>T2) (NO in step S105), the processing proceeds to step S107. In step S107, the CPU 601 executes the color misregistration adjustment according to the second color misregistration adjustment before the image forming processing. As described above, the CPU 601 selectively executes different types of color misregistration adjustment because it is known that the misregistration amount of relative image positions is increased if the temperature change amount ΔT becomes greater. If it is assumed that the color misregistration amount exceeds an allowable range, the CPU 601 executes the color misregistration adjustment control before executing the image forming processing. In other words, if there is a possibility that the color misregistration amount exceeds the allowable range, the CPU 601 places higher priority on image quality than down time. Further, according to the experiment, the misregistration amount of the position in the main scanning direction has not exceeded the allowable range if the temperature change amount ΔT is less than T2. Therefore, when the temperature change amount ΔT is less than T2, the CPU 601 only executes correction of the position in the sub-scanning direction.

After the CPU 601 executes the processing in step S106 or S107, the CPU 601 executes the image forming processing in step S108, and ends the processing of FIG. 10.

According to the processing illustrated in FIG. 10, the temperature difference T0 is a threshold value for determining whether to execute the color misregistration correction control when the image forming processing is executed. Further, the temperature difference T1 is a threshold value for determining whether to execute the color misregistration correction at the timing before or after executing the image forming processing. The temperature difference T2 is a threshold value for determining the type of color misregistration correction executed before the image forming processing from among the first and the second color misregistration adjustment.

Accordingly, in a case where change in the interior temperature from the previous color misregistration adjustment is smaller than the threshold value T1 before the image forming processing is started (i.e., temperature change amount ΔT is kept within the first temperature difference (ΔT≤T1)), downtime does not occur in a period before executing the image forming processing because the color misregistration adjustment is executed after the image forming processing is completed. Accordingly, the above-described configuration is useful for a user who executes printing relatively frequently.

On the other hand, in a case where the temperature change amount ΔT is greater than the threshold value T1 (T1<ΔT), the color misregistration adjustment is executed before the printing processing because the color misregistration amount in the sub-scanning direction may be large. Because the first color misregistration adjustment using the short pattern is executed when the temperature change amount ΔT is less than the threshold value T2, downtime before the image forming processing can be minimized.

Further, in a case where the temperature change amount ΔT is greater than the threshold value T2, the second color misregistration adjustment using the long pattern, which prioritizes the color misregistration correction, is executed before the image forming processing because the color misregistration amount may be large. However, the above-described condition may be satisfied less frequently because it is assumed that the change in temperature greater than 4° C. (T2) is less likely to occur in the actual usage environment. Therefore, in practice, considerable downtime caused by the second color misregistration adjustment before executing the image forming processing may occur less frequently.

As described above, by determining the type and the execution timing of the color misregistration adjustment according to the temperature change amount ΔT correlating with a color misregistration change amount, the productivity of the image forming apparatus 100 can be improved while reducing the downtime before the printing processing caused by the color misregistration adjustment.

According to the present exemplary embodiment, in a case where the color misregistration correction is executed when the image forming processing is to be executed, the color misregistration correction is executed at any timing before or after executing the image forming processing according to a comparison result (temperature change amount ΔT) of the interior temperatures at the previous color misregistration correction and the current interior temperature. With this configuration, the downtime can be minimized by executing the color misregistration correction before the image forming processing as necessary. Further, even if the color misregistration correction is executed before the image forming processing, occurrence frequency of considerable downtime can be minimized by changing the method of the color misregistration correction before the image forming processing according to the temperature change amount ΔT.

Furthermore, in the present exemplary embodiment, the embodiment of the first or the second color misregistration adjustment such as the number of correction pattern sets is not limited to the above described examples. To reduce downtime, the time of the first color misregistration adjustment may only have to be shorter than that of the second color misregistration adjustment. To obtain the appropriate correction accuracy, the correction accuracy of the second color misregistration adjustment may only have to be higher than that of the first color misregistration adjustment. The above-described time or the correction accuracy can be adjusted by the number of pattern sets, a pattern width, or an interval between the patterns, and thus various modifications can be applied thereto.

Further, in the processing illustrated in FIG. 10, when the temperature change amount ΔT is greater than the threshold value T1 (T1<ΔT), two options have been provided by comparing the temperature change amount ΔT with the temperature difference T2. However, when the temperature change amount ΔT is greater than the threshold value T1 (T1<ΔT), three or more options may be provided by providing more than three types of color misregistration adjustment and increasing the number of temperature differences as the threshold values.

Furthermore, in step S109, the second color misregistration adjustment has been executed. Therefore, the processing performed in step S109 is the same as that performed in step S107. However, the configuration is not limited thereto, and color misregistration adjustment other than that performed in step S107, i.e., a third color misregistration adjustment using a third correction pattern may be executed in step S109. In this case, time of the third color misregistration adjustment is set to be longer than that of the first color misregistration adjustment, and the correction accuracy is set to be higher than that of the first color misregistration adjustment.

Although the third correction pattern is not illustrated, for example, the third correction pattern may be formed by adding or reducing a certain number of sets configured of the correction patterns 501 to/from the long pattern arrangement illustrated in FIG. 8. Alternatively, the third correction pattern may be formed by reducing one set configured of the correction patterns 521 and 522 from the long pattern arrangement, or by adding a certain number of sets thereto. Furthermore, the third correction pattern may be formed by reflecting both of the above-described changes. The time or the correction accuracy of any one of the second color misregistration adjustment and the third color misregistration adjustment can be set to be longer or higher than that of the other.

While the present disclosure has been described in detail with reference to the exemplary embodiments, it is to be understood that the disclosure is not limited to the above-described specific exemplary embodiments, and many variations which do not depart from the essential spirit of the disclosure should be included within the scope of the present disclosure.

According to the aspect of the present disclosure, the color misregistration correction control can be executed at an appropriate timing, and thus it is possible to suppress the downtime while correcting the relative positions of the images with high accuracy.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2014-002381 filed Jan. 9, 2014, which is hereby incorporated by reference herein in its entirety.

What is claimed is:

1. An image forming apparatus comprising:

an image bearing member configured to carry and convey an image;

a first image forming unit configured to form a first image in a first color on the image bearing member;

a second image forming unit configured to form a second image in a second color different from the first color on the image bearing member;

a measurement unit configured to detect positions of measurement images formed on the image bearing member by the first image forming unit and the second image forming unit;

a correction unit configured to correct a position of the first image and a position of the second image based on the positions detected by the measurement unit;

a detection unit configured to detect a temperature of the image forming apparatus; and a determining unit configured to determine timing for causing the first image forming unit and the second image forming unit to form the measurement images based on the temperature detected by the detection unit, wherein the timing determined by the determining unit includes:

a first timing for the first image forming unit and the second image forming unit to form the measurement images prior to the first image forming unit and the second image forming unit forming an image according to a print instruction, and a second timing for the first image forming unit and the second image forming unit to form the measurement images after the first image forming unit and the second image forming unit formed the image according to the print instruction.

2. The image forming apparatus according to claim 1, wherein the determining unit determines the timing based on a difference between a previous temperature detected by the detection unit when the positions are detected by the measurement unit and a current temperature detected by the detection unit.

3. The image forming apparatus according to claim 2, wherein, in a case where the difference is greater than a first threshold value and smaller than a second threshold value, the second timing is determined by the determining unit, and the first and second image forming units form a second measurement image, wherein, in a case where the difference is greater than the second threshold value and smaller than a third threshold value, the first timing is determined by the determining unit, and the first and second image forming units form a first measurement image, wherein, in a case where the difference is greater than the third threshold value, the first timing is determined by the determining unit, and the first and second image forming units form the second measurement image, and wherein time taken for the first measurement image on the image bearing member to pass a measurement region of the measurement unit is shorter than time taken for the second measurement image on the image bearing member to pass the measurement region.

4. The image forming apparatus according to claim 3, wherein the correction unit corrects a position of the first image and a position of the second image in a conveyance direction of the image bearing member based on the detected positions of the first measurement image, and wherein the correction unit corrects a position of the first image and a position of the second image in a direction orthogonal to the conveyance direction of the image bearing member.

5. The image forming apparatus according to claim 2, wherein the determining unit does not form the measurement images in a case where the difference is smaller than the first threshold value.

6. The image forming apparatus according to claim 3, wherein, in a case where the difference is greater than the first threshold value and smaller than the second threshold value, the second timing is determined by the determining unit, and wherein, in a case where the difference is greater than the second threshold value, the first timing is determined by the determining unit.

* * * * *